US009054435B2

(12) United States Patent
Petrucci

(10) Patent No.: US 9,054,435 B2
(45) Date of Patent: Jun. 9, 2015

(54) CONVERSION TERMINAL DEVICE AND METHOD FOR COUPLING DISSIMILAR METAL ELECTRICAL COMPONENTS

(71) Applicant: GM GLOBAL TECHNOLOGY OPERATIONS LLC, Detroit, MI (US)

(72) Inventor: David R. Petrucci, Warren, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 144 days.

(21) Appl. No.: 13/945,208

(22) Filed: Jul. 18, 2013

(65) Prior Publication Data

US 2015/0024643 A1 Jan. 22, 2015

(51) Int. Cl.
*H01R 9/24* (2006.01)
*H01R 13/03* (2006.01)

(52) U.S. Cl.
CPC ..... *H01R 13/03* (2013.01)

(58) Field of Classification Search
CPC ..... H01R 13/03; H01R 4/184
USPC ..... 439/886, 887
See application file for complete search history.

(56) References Cited

U.S. PATENT DOCUMENTS

| | | | | | |
|---|---|---|---|---|---|
| 4,969,842 | A * | 11/1990 | Davis | ..... | 439/886 |
| 5,163,856 | A * | 11/1992 | McGaffigan et al. | ..... | 439/887 |
| 5,298,683 | A | 3/1994 | Taylor | | |
| 5,749,740 | A | 5/1998 | Swift et al. | | |
| 7,357,681 | B2 * | 4/2008 | Yamagami et al. | ..... | 439/886 |
| 8,266,798 | B2 | 9/2012 | Martauz | | |
| 8,403,714 | B2 * | 3/2013 | Nakata et al. | ..... | 439/886 |
| 2013/0130569 | A1 | 5/2013 | Sato | | |

* cited by examiner

*Primary Examiner* — Tho D Ta
(74) *Attorney, Agent, or Firm* — Cantor Colburn LLP

(57) ABSTRACT

In one aspect, a conversion terminal device for electrically coupling dissimilar metal components is provided. The device includes a body having a first layer coupled to a second layer. The first layer is formed from a first metal and the second layer is formed from a second metal different from the first metal. The body includes a first connector portion and a second connector portion. The first connector portion is configured to couple to a first electrical component made of the first metal, and the second connector portion is configured to couple to a second electrical component made of the second metal to facilitate electrically coupling the first electrical component and the second electrical component.

20 Claims, 3 Drawing Sheets

CONVERSION TERMINAL DEVICE AND METHOD FOR COUPLING DISSIMILAR METAL ELECTRICAL COMPONENTS

FIELD OF THE INVENTION

The subject invention relates generally to devices for connecting dissimilar metal components and, more specifically, to devices for electrically coupling dissimilar-metal components.

BACKGROUND

Some known vehicles require electrical coupling between components or equipment. Insulated copper based cable is commonly used for automotive wiring due to copper's high conductivity, good corrosion and oxidation resistance, and suitable mechanical strength. However, copper and copper based metals are relatively heavy and expensive.

Cost and weight savings in automotive electrical wiring applications has made aluminum based cables an attractive alternative to copper based wires. However, some known wiring and electrical connectors may remain copper based. As such, a transition may exist somewhere in the electrical circuit between an aluminum based portion of the circuit and a copper based portion of the circuit. Often this transition may occur at the terminal, which may remain copper based for reasons of size and complexity of shape that can be more easily achieved with copper based materials as opposed to aluminum based materials. However, a connection between dissimilar metals such as aluminum based cable and a copper based terminal can produce an unwanted galvanic corrosion. This is caused by the galvanic incompatibility of the two materials and results in the destruction of one or both of the materials and reduced or eliminated electrical contact therebetween.

SUMMARY OF THE INVENTION

In one aspect, a conversion terminal device for electrically coupling dissimilar metal components is provided. The device includes a body having a first layer coupled to a second layer. The first layer is formed from a first metal and the second layer is formed from a second metal different from the first metal. The body includes a first connector portion and a second connector portion. The first connector portion is configured to couple to a first electrical component made of the first metal, and the second connector portion is configured to couple to a second electrical component made of the second metal to facilitate electrically coupling the first electrical component and the second electrical component.

In another aspect, a vehicle is provided. The vehicle includes a body, a first electrical component fabricated from a first metal, a second electrical component fabricated from a second metal different from the first metal, and a conversion terminal device. The conversion terminal device includes a device body having a first layer coupled to a second layer. The first layer is formed from a first metal and the second layer is formed from a second metal different from the first metal. The device body includes a first connector portion and a second connector portion. The first connector portion is configured to couple to a first electrical component made of the first metal, and the second connector portion is configured to couple to a second electrical component made of the second metal to facilitate electrically coupling the first electrical component and the second electrical component.

In yet another aspect, a method of manufacturing a conversion terminal device for electrically coupling dissimilar metal components is provided. The method includes providing a first layer fabricated from a first metal, providing a second layer fabricated from a second metal different from the first metal, and coupling the first layer to the second layer to form a body. The method further includes forming a first body portion configured to couple to a first electrical component made of the first metal, and forming a second body portion configured to couple to a second electrical component made of the second metal to electrically couple the first electrical component to the second electrical component.

The above features and advantages and other features and advantages of the invention are readily apparent from the following detailed description of the invention when taken in connection with the accompanying drawings.

BRIEF DESCRIPTION OF THE DRAWINGS

Other features, advantages and details appear, by way of example only, in the following detailed description of embodiments, the detailed description referring to the drawings in which.

DESCRIPTION OF THE EMBODIMENTS

Figure 1:
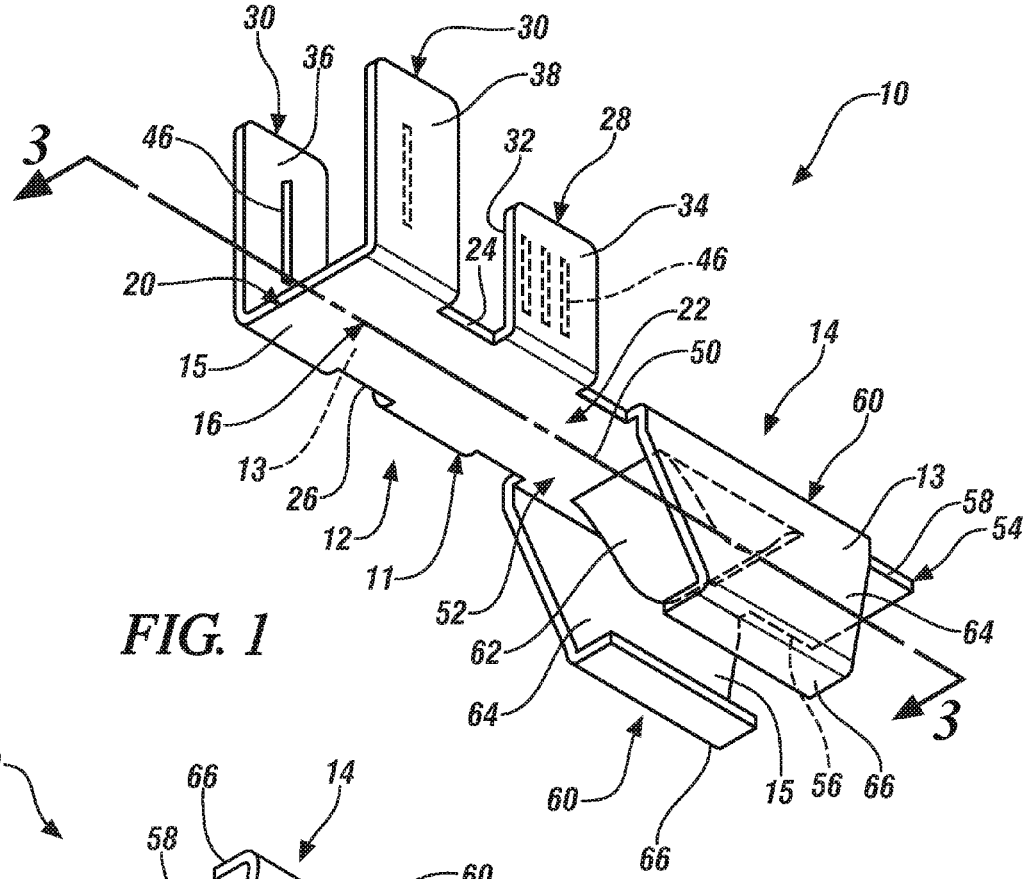
FIG. 1 is a perspective view of an exemplary conversion terminal device.

The following description is merely exemplary in nature and is not intended to limit the present disclosure, its application or uses. It should be understood that throughout the drawings, corresponding reference numerals indicate like or corresponding parts and features.

Described herein are exemplary conversion terminal devices for coupling two components fabricated from dissimilar metals. The devices generally include a body formed from layers of dissimilar metal, with one layer for coupling to a similar-metal component and another layer for coupling to a different, similar-metal layer. Accordingly, the present devices reduce or prevent galvanic corrosion that may occur, for example, when using some known terminals to couple dissimilar metal electrical components.

Figure 2:
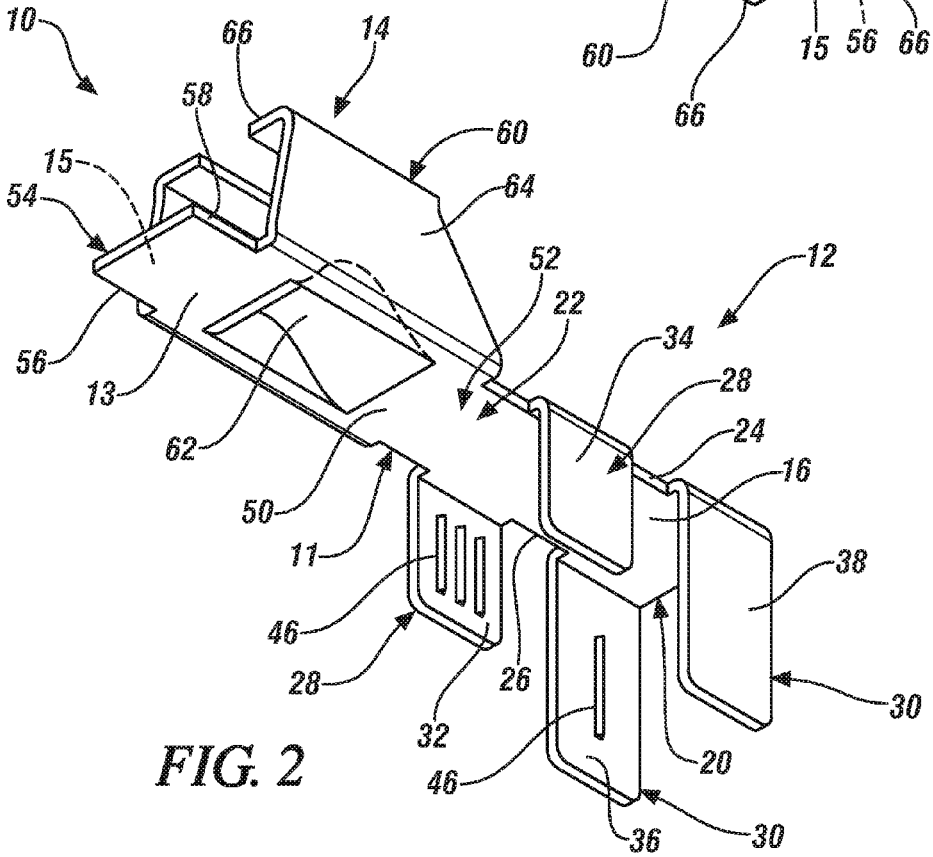
FIG. 2 is another perspective view of the conversion terminal device shown in FIG. 1.
Figure 3:
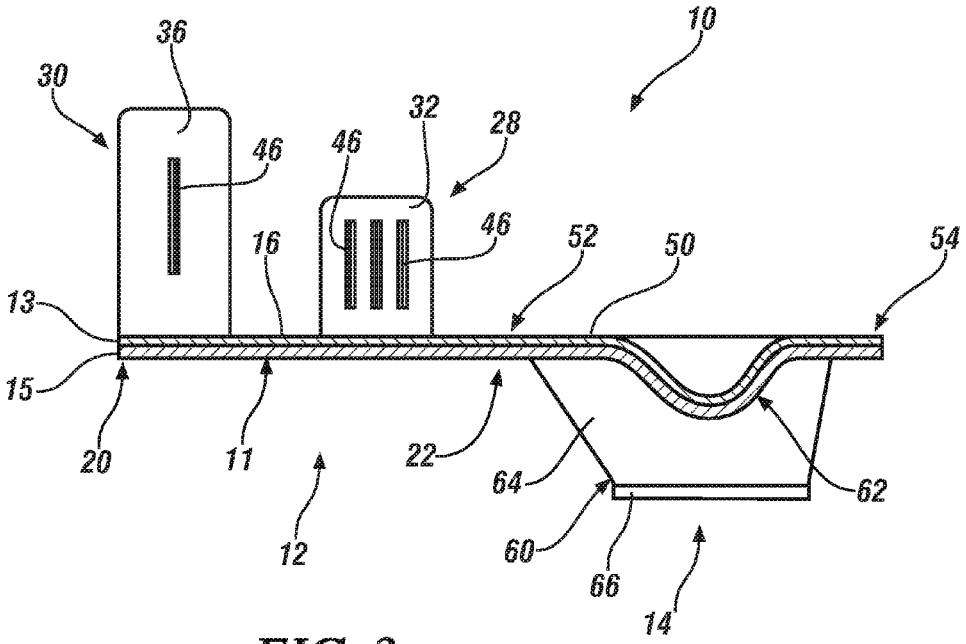
FIG. 3 is a cross-sectional view of the conversion terminal device shown in FIG. 1 and taken along line 3-3.

FIGS. 1-3 illustrate an exemplary conversion terminal device 10 that generally includes a body 11 having a first connector portion 12 and a second connector portion 14. Body 11 is fabricated from dissimilar metal layers such that body 11 includes a first layer or surface 13 and an opposed second layer or surface 15. First surface 13 is fabricated from a first metal (e.g., aluminum, aluminum alloy) and second surface 15 is fabricated from a second metal that is different from the first metal (e.g., copper, copper alloy). In the exemplary embodiment, device 10 is formed by coupling first layer 13 and second layer 15 via cladding, i.e., a metallurgical bond created between two metals when they are pressed together under high-pressure, then heated to relieve stress and to allow metallurgical interdiffusion.

Figure 6:
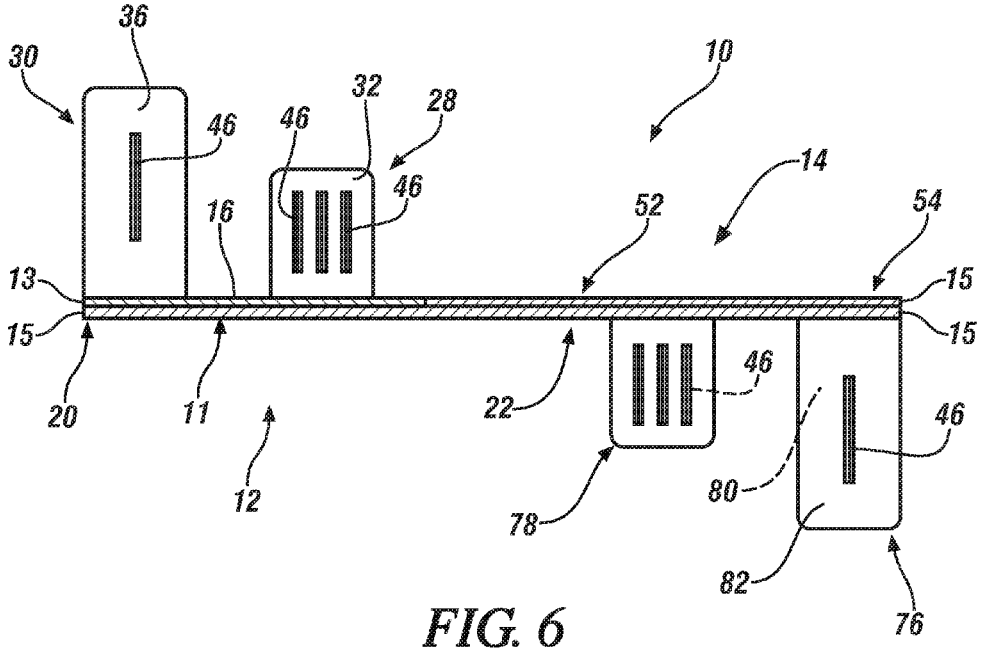
FIG. 6 is a cross-sectional view of another alternate embodiment of the conversion terminal device.

In the exemplary embodiment, body 11 may include any number of dissimilar metal layers. For example, first connector portion 12 may include a third metal layer (not shown) fabricated from a third metal that is different from the first and second metals to facilitate coupling to an electrical component fabricated from the third metal. Moreover, only a portion of first and second layers 13 and 15 may be fabricated from a dissimilar metal. For example, as shown in FIG. 6, first layer 13 of first connector portion 12 is fabricated from the first metal, and first layer 13 of second connector portion 14 is fabricated from the second metal. Alternatively, instead of second connector portion 14 formed from two layers 13, 15 of the same metal, second connector portion 14 may be formed with a single layer having a thickness of the two dissimilar metal layers 13, 15 of first connector portion 12. However, any portion of body 11 may be fabricated from a particular metal to provide a suitable contact point for an electrical component fabricated from the same particular metal.

Figure 4:
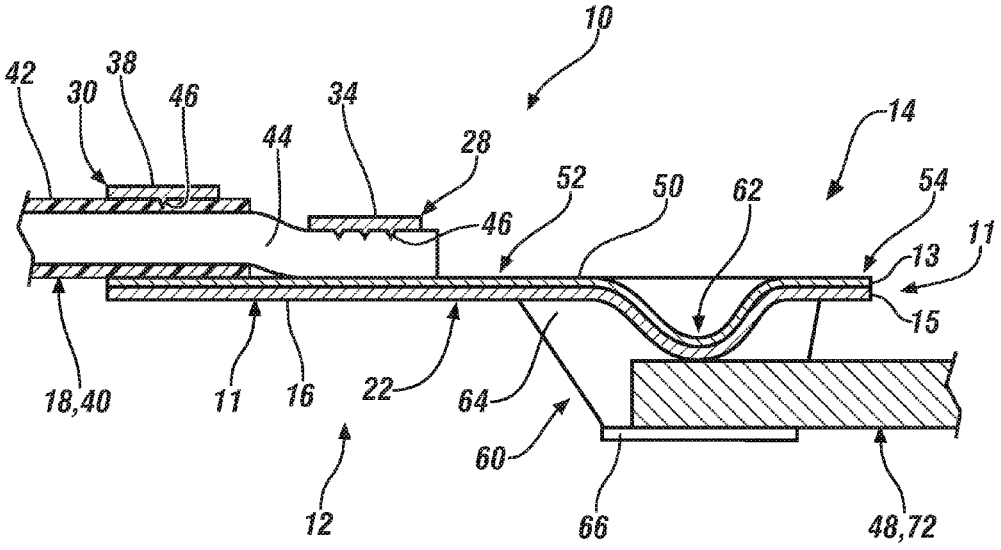
FIG. 4 is a cross-sectional view of the conversion terminal device shown in FIGS. 1-3 and coupled to dissimilar-metal electrical components.

In the exemplary embodiment, first connector portion 12 includes a contact member 16 configured to provide an electrical contact surface for an electrical component 18 (FIG. 4). Contact member 16 includes opposed first and second ends 20 and 22 and opposed sides 24 and 26. First connector portion 12 also includes a first pair of opposed tabs 28 and may include a second pair of opposed tabs 30 each extending from contact member sides 24 and 16. Tabs 28 each include inner surfaces 32 made of the first metal layer 13 and outer surfaces 34 made of the second metal surface 15. Similarly, tabs 30 each include inner surfaces 36 made of the first metal layer 13 and outer surfaces 38 made of the second metal layer 15.

Each tab of pairs 28, 30 is configured to be folded or crimped inward towards the opposed tab to facilitate securing electrical component 18 to contact member 16. As such, when electrical component 18 is located between unfolded tabs 28 and/or 30 (see FIGS. 1-3), inner surfaces 32 and/or inner surfaces 36 are folded toward and into contact with electrical component 18. For example, as shown in FIG. 4, electrical component 18 may be an electrical wire 40 having a sheathed portion 42 and an exposed portion 44. Tabs 30 are folded over onto sheathed portion 42 and tabs 28 are folded over onto exposed portion 44, respectively, to facilitate securing sheathed portion 42 and exposed portion 44 to first layer 13 of contact member 16. In the exemplary embodiment, tabs 30 are longer than tabs 28 to accommodate the larger diameter of sheathed portion 42 as compared to the smaller diameter of exposed portion 44. However, tabs 28 and 30 may have any length that enables device 10 to function as described herein. Although illustrated with tabs 28, 30 to facilitate an electrical connection between first connector portion 12 and electrical component 18, first connector portion 12 may have any suitable fastening mechanism that enables device 10 to secure component 18 thereto.

In the exemplary embodiment, one or both tabs of pairs 28 and/or 30 may include one or more teeth 46 on tab inner surfaces 32, 36. Teeth 46 are configured to engage and/or grip electrical component 18 to facilitate securing electrical component 18 to contact member 16 to establish and maintain an electrical coupling therebetween. For example, as shown in FIG. 4, teeth 46 cut into or otherwise engage wire 40 to facilitate preventing axial movement of wire 40 relative to first connector portion 12. In the exemplary embodiment, teeth 46 are oriented substantially perpendicular to the axial length of wire 40. However, teeth 46 may have any orientation on inner surfaces 32 and/or 36 that enables device 10 to function as described herein. For example, teeth 46 may be oriented diagonally to the axial length of wire 40.

In the exemplary embodiment, second connector portion 14 is a terminal end configured to electrically couple to an electrical component 48 (FIG. 4). Second connector portion 14 includes a base plate 50 having opposed first and second ends 52 and 54 and opposed sides 56 and 58. Base plate first end 52 is coupled to contact member second end 22. Second connector portion 14 also includes a pair of opposed receiving wings 60 and a biasing member 62. Receiving wings 60 each include an extension portion 64 and a tab portion 66. Extension portions 64 extend from base plate sides 56, 58 substantially perpendicular thereto. Tab portions 66 each extend toward each other from extension portions 64 and are oriented substantially perpendicular to base plate 50. Biasing member 62 is a portion of base plate 50 that extends toward tab portions 66 to thereby bias electrical component 48 into contact with tab portions 66 and establish an electrical connection therebetween. For example, biasing member 62 may be a protrusion or dimple formed in base plate 50, as shown in FIGS. 1-3. Alternatively, biasing member 62 may have any shape that enables device 10 to function as described herein. Moreover, although illustrated with receiving wings 60 and biasing member 62 to facilitate an electrical connection between second connector portion 14 and electrical component 48, second connector portion 14 may have any suitable fastening mechanism that enables device 10 to secure component 48 thereto.

FIG. 4 illustrates device 10 used to mechanically and electrically couple electrical component 18 and electrical component 48. In the exemplary embodiment, electrical component 18 is wire 40 that may be connected to components such as receivers, electronic modules, or power modules, and electrical component 48 may be a fuse block 72 of a vehicle electrical system. Wire 40 and fuse bock 72 are fabricated from dissimilar metals (e.g., aluminum and copper) such that directly coupling wire 40 to fuse block 72 may cause a galvanic reaction causing oxidation and/or corrosion that may reduce or eliminate electrical contact therebetween. Accordingly, conversion terminal device 10 is coupled between wire 40 and fuse block 72 to facilitate preventing or reducing galvanic reactions. Alternatively, electrical components 18 and 48 may be any number of different electrical components fabricated from dissimilar metals.

In the exemplary embodiment, wire exposed portion 44 is electrically coupled to first metal layer 13 of contact member 16. Wire exposed portion 44 and contact member 16 are fabricated from the same metal material (e.g., aluminum) such that the contact between the two components does not cause a galvanic reaction. Fuse block 72 is at least partially inserted between receiving wings 60 and biasing member 62 and is electrically coupled to base plate 50 via receiving wings 60 and/or biasing member 62. Similarly, fuse block 72 and second connector portion 14 are fabricated from the same material (e.g., copper) such that contact between the surfaces does not cause a galvanic reaction. Accordingly, dissimilar metal wire 40 and fuse block 72 are electrically coupled without a direct mechanical coupling, which facilitates preventing galvanic reactions between the two electrical components.

Figure 5:
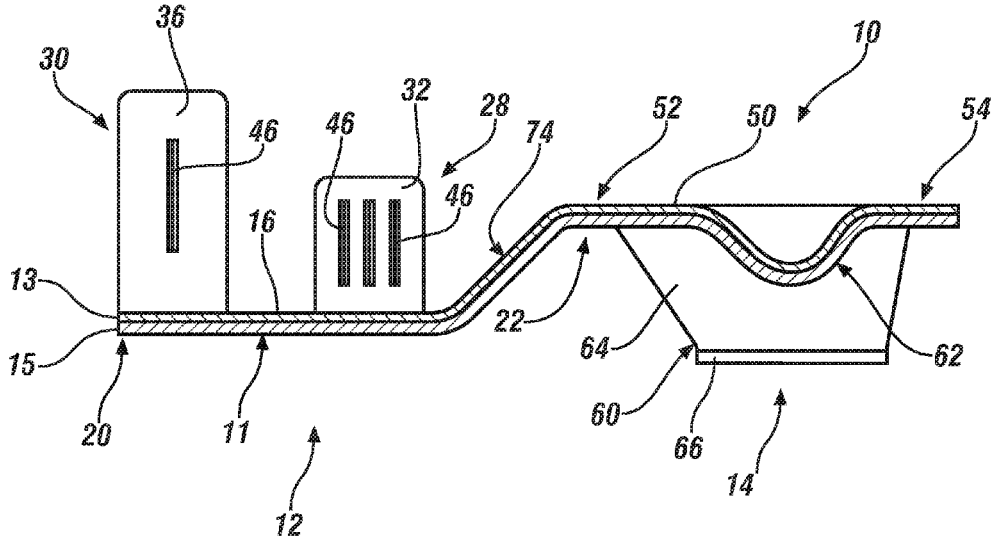
FIG. 5 is a cross-sectional view of an alternate embodiment of the conversion terminal device.

FIG. 5 illustrates a cross-sectional view of another embodiment of device 10 that includes an off-setting bridge member 74. In the exemplary embodiment, bridge member 74 is oriented angularly between first connector portion 12 and second connector portion 14. Because first connector portion 12 and second connector portion 14 are offset, electrical components 18 and 48 may be oriented substantially in-line, which may facilitate space saving arrangements of components (not shown) surrounding device 10.

FIG. 6 illustrates a cross-sectional view of another embodiment of device 10 that includes second connector portion 14 having a connector arrangement similar to first connector portion 12. In the exemplary embodiment, second connector portion 14 includes a third pair of opposed tabs 76 and a fourth pair of opposed tabs 78 instead of the terminal end arrangement shown in FIGS. 1-4. Third tabs 76 and fourth tabs 78 extend from base plate sides 56, 58 and include inner surfaces 80 made of the second metal layer 15 and outer surfaces 82 also made of the second metal layer 15. As illustrated in FIG. 6, first layer 13 of first connector portion 12 is fabricated from the first metal, while second layer 15 of first connector portion 12 and top and bottom second metal layers 15 of second connector portion 14 are fabricated from the second metal. Tabs 76, 78 facilitate securing electrical component 48 (e.g., a copper wire) in a manner similar to tabs 28 and 30. Moreover, tab inner surfaces 80 may include any number of teeth 46 as described herein.

In the exemplary embodiment, a method of manufacturing conversion terminal device 10 includes coupling dissimilar metal layers 13 and 15 to form body 11 that has first connector portion 12 and second connector portion 14. The coupling may be accomplished via cladding. First connector portion 12 includes contact member 16, first pair of tabs 28, and second pair of tabs 30. Tabs 28 and 30 are formed such that they can be folded inward toward each other to facilitate securing an electrical component against contact member 16. Teeth 46 may be formed on tabs 28 and/or 30 to facilitate securing the electrical component to first connector portion 12. Second connector portion 14 includes base plate 50, opposed receiving wings 60, and biasing member 62. Receiving wings 60 are each formed to include extension portion 64 and tab portion 66. Biasing member 62 is formed such that member 62 biases a second electrical component toward receiving wings 60 to establish an electrical connection to base plate 50, first connector portion 12, and the electrical component secured to first connector portion 12. Further, body 11 may be formed with bridge member 74 between first connector portion 12 and second connector portion 14.

Alternatively, second connector portion 14 may be formed to include third pair of tabs 76 and fourth pair of tabs 78, which are formed such that they can be folded inward toward each other to facilitate securing an electrical component against base plate 50. Teeth 46 may be formed on tabs 76 and/or 78 to facilitate securing the electrical component to the second connector portion 14.

Described herein are exemplary electrical coupling devices for coupling dissimilar-metal electrical components. The devices include a body formed from two or more dissimilar metals each corresponding to the dissimilar-metal components. The metal surfaces of the body are each coupled to a similar-metal electrical component to provide electrical coupling between the surfaces formed from the same metal. Accordingly, the devices facilitate an electrical coupling between dissimilar-metal electrical components to establish an electrical path therebetween with improved conductance and reduced resistance. As such, typical mechanical and electrical connections between components may be replaced, reducing extensive and costly copper wiring, reducing vehicle mass, and preventing corrosion and oxidation at connection points.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the application.

What is claimed is:

1. A conversion terminal device for electrically coupling dissimilar metal components, the device comprising:

a body having a first layer coupled to a second layer, the first layer formed from a first metal and the second layer formed from a second metal different from the first metal, the body including a first connector portion and a second connector portion, wherein the first connector portion is configured to couple to a first electrical component made of the first metal, and the second connector portion is configured to couple to a second electrical component made of the second metal to facilitate electrically coupling the first electrical component and the second electrical component.

2. The device of claim 1, wherein the first metal is aluminum and the second metal is copper.

3. The device of claim 1, wherein the first metal layer is coupled to the second metal layer by cladding.

4. The device of claim 1, wherein the first connector portion comprises a contact member and a pair of tabs extending from the contact member, the tabs configured for folding onto the first electrical component to facilitate securing the first electrical component to the contact member.

5. The device of claim 4, wherein at least one of the tabs comprises teeth configured to engage the first electrical component to facilitate securing the first electrical component to the contact member.

6. The device of claim 4, wherein the first connector portion further comprises a second pair of tabs extending from the contact member, the second pair of tabs configured for folding onto the first electrical component to facilitate securing the first electrical component to the contact member.

7. The device of claim 6, wherein at least one of the first and second electrical components is an electrical wire.

8. The device of claim 1, wherein the second connector portion comprises a terminal end configured to couple to a fuse block fabricated from the second metal.

9. The device of claim 8, wherein the terminal end comprises a base plate and a pair of receiving wings extending from the base plate.

10. The device of claim 9, further comprising a biasing member coupled to the base plate, the biasing member configured to bias at least a portion of the fuse block toward the receiving wings.

11. A vehicle comprising:

a body;

a first electrical component fabricated from a first metal;

a second electrical component fabricated from a second metal different from the first metal; and a conversion terminal device comprising:

a device body having a first layer coupled to a second layer, the first layer formed from a first metal and the second layer formed from a second metal different from the first metal, the device body including a first connector portion and a second connector portion, wherein the first connector portion is configured to couple to a first electrical component made of the first metal, and the second connector portion is configured to couple to a second electrical component made of the second metal to facilitate electrically coupling the first electrical component and the second electrical component.

12. The vehicle of claim 11, wherein the first metal is aluminum and the second metal is copper.

13. The vehicle of claim 12, wherein the first electrical component is an aluminum wire and the second electrical component is a copper fuse block.

14. The vehicle of claim 11, wherein the first metal layer is coupled to the second metal layer by cladding.

15. The vehicle of claim 11, wherein the first connector portion comprises a contact member and a pair of tabs extending from the contact member, the tabs configured for folding onto the first electrical component to facilitate securing the first electrical component to the contact member.

16. The vehicle of claim 15, wherein at least one of the tabs comprises teeth configured to engage the first electrical component to facilitate securing the first electrical component to the contact member.

17. The vehicle of claim 11, wherein the second electrical component comprises a fuse block fabricated from the second metal, the second connector portion configured to couple to the fuse block.

18. The vehicle of claim 17, wherein the second connector portion comprises a base plate, a pair of receiving wings extending from the base plate, and a biasing member coupled to the base plate.

19. A method of manufacturing a conversion terminal device for electrically coupling dissimilar metal components, the method comprising:

providing a first layer fabricated from a first metal;

providing a second layer fabricated from a second metal different from the first metal;

coupling the first layer to the second layer to form a body;

forming a first body portion configured to couple to a first electrical component made of the first metal; and forming a second body portion configured to couple to a second electrical component made of the second metal to electrically couple the first electrical component to the second electrical component.

20. The method of claim 18, wherein the coupling comprises cladding the first metal layer to the second metal layer.

* * * * *